United States Patent [19]

Carnwath

[11] 4,059,057

[45] Nov. 22, 1977

[54] PALLET ASSEMBLY

[75] Inventor: Joseph W. Carnwath, Pipersville, Pa.

[73] Assignee: Pennsylvania Pacific Corporation, Warminster, Pa.

[21] Appl. No.: 704,400

[22] Filed: July 12, 1976

[51] Int. Cl.[2] ..... B65D 19/00

[52] U.S. Cl. ..... 108/51.1; 108/52.1

[58] Field of Search ..... 108/52.1, 51.1

[56] References Cited

U.S. PATENT DOCUMENTS

| | | | |
|---|---|---|---|
| 1,835,825 | 12/1931 | Thierry | 108/51.1 |
| 2,625,355 | 1/1953 | Adams | 108/52.1 |
| 2,639,050 | 5/1953 | Hoffman, Jr. | 108/52.1 X |
| 2,890,849 | 6/1959 | Fogarty et al. | 108/51.1 |
| 2,933,339 | 4/1960 | Alvden | 108/51.1 X |
| 2,991,965 | 7/1961 | Drieborg | 108/51.1 |
| 3,294,041 | 12/1966 | Lessheim | 108/52.1 X |
| 3,380,404 | 4/1968 | Shell | 108/52.1 |

FOREIGN PATENT DOCUMENTS

| | | | |
|---|---|---|---|
| 1,340,328 | 12/1973 | United Kingdom | 108/52.1 |
| 921,612 | 3/1963 | United Kingdom | 108/51.1 |

*Primary Examiner*—Roy D. Frazier
*Assistant Examiner*—Peter A. Aschenbrenner
*Attorney, Agent, or Firm*—Smith, Harding, Earley & Follmer

[57] ABSTRACT

A pallet assembly combines a structurally simple, although relatively expensive, heavy-duty, high quality pallet with an expendable, inexpensive, light-weight, and extraordinarily simple shipper skid. The heavy-duty pallet is made of solid hardwood lumber or other durable material such as plastic and is designed for long lasting service. The expendable shipper skid is made of a light-weight hardwood, plastic or corrugated fiberboard. The pallet assembly is entered by a forklift from one direction and the shipper skid and a load thereon is arranged to be lifted from the pallet assembly by a forklift entering from a direction displaced 90° from said first mentioned direction. Notches in the intermediate as well as the end runners of the heavy-duty pallet allow the tines of the forklift to pass through the entire pallet assembly when the expendable shipper skid is to be lifted. Only the inexpensive expendable shipper skid is shipper with the load. This avoids risking damage to or on return of the more expensive heavy-duty pallet.

2 Claims, 3 Drawing Figures

PALLET ASSEMBLY

BACKGROUND OF THE INVENTION

1. Field of the Invention

This invention relates to handling and shipping equipment and more particularly to pallets and skids as are used in manufacturing plants, warehouses and the like to support manufactured and other merchandise for ready movement by forklift trucks and for shipping such merchandise to remote points.

2. Description of the Prior Art

Many forms of merchandise-supporting devices such as pallets have been proposed in the prior art. However, manufacturers and warehousemen who use pallets in their own plants and also use pallets to ship merchandise out of their plants have had a problem that has increased costs of shipping. In order for pallets to have a service life long enough to make their use economically practical, expensive, heavy-duty, high quality pallets made of solid hardwood lumber have been utilized. Because of the significant value of the pallets to their owners, their practice has been to require the return of the pallets to them for use over and over again in shipping. This practice appears to have been less than satisfactory, however, because of damage to or loss of pallets resulting from mishandling or abuse and failure of the pallets to be returned.

A pallet assembly proposed to solve the above problem is disclosed in U.S. Pat. No. 3,294,041. That assembly includes a permanent pallet portion, and a low cost disposable pallet section 33. The disposable pallet section 33 supports the product load to be shipped. Because of the low cost of the disposable pallet section 33 it is said that the shipper need not be concerned whether it is returned or not. The disposable pallet section 33 includes a plurality of projecting locater blocks 39 for holding the disposable pallet section 33 against movement when the disposable pallet section is mounted on the permanent pallet. The downwardly projecting blocks 39 also provide supporting legs or feet for the disposable pallet section 33. The structure of the disposable pallet section 33, including the downwardly projecting blocks 39, add to the cost and weight of the disposable pallet section, and also to the structural complexity of the permanent pallet with which the disposable pallet section is used.

SUMMARY OF THE INVENTION

Among the objects of the present invention is the provision of an improved pallet assembly comprising a heavy-duty, high quality, permanent pallet of simple structure that is uniquely designed for use with a separable expendable inexpensively constructed shipper skid.

A further object of the invention is to provide an improved heavy-duty, high quality pallet.

Another object is to provide an improved inexpensive, simply constructed expendable shipper skid.

In accomplishing these and other objects, the separable assembly according to the present invention includes a light-weight shipper skid that is simple in construction and inexpensive, and hence, economically practical for one-way use, that is, for a single shipment and then discarded, although adequate to support the customary loads of merchandise for shipment. The shipper skid is provided with a pair of parallel end runners and an intermediate runner parallel with said end runners, with a plurality of parallel deckboards extending transversely of said runners and secured to an adjacent edge of each, and with each of the end runners being inset from the associated ends of the deckboards. The depth of said runners is selected to provide sufficient ground clearance for ease of forklift handling.

The heavy-duty permanent pallet normally is retained at the manufacturing plant or warehouse, and is designed for long lasting service. The permanent pallet is provided with a pair of parallel end runners and an intermediate runner parallel therewith, with bottom boards or plates extending transversely of and secured to an adjacent lower edge of said runners. The permanent pallet is also provided with top boards including a pair of parallel end boards and a pair of intermediate boards that are parallel therewith. All of the top boards extend transversely of the runners, being secured to the upper edges thereof, and with the intermediate top boards being closely spaced so as to form a groove. In accordance with the invention, the width of the groove is approximately equal to or slightly greater than the width of the intermediate runner provided on the shipper skid. The shipper skid end runners, as noted, are inset from the ends of the associated deckboards of the shipper skid. Thus, when the shipper skid is placed on the permanent pallet with the intermediate runner of the shipper skid positioned in said groove, the end runners of the shipper skid lie alongside an inside edge of a top end board of the permanent pallet. A notch is provided in each of the runners of the permanent pallet between each top end board and intermediate board. These notches admit tines of a forklift approaching from a first direction to allow the shipper skid with its load to be lifted from the permanent pallet. The assembly of the shipper skid and permanent pallet may be lifted by a forklift approaching from a direction spaced 90° from said first direction.

BRIEF DESCRIPTION OF THE DRAWINGS

A better understanding of the present invention will be had from the following detailed description when read in conjunction with accompanying drawings wherein.

DETAILED DESCRIPTION

Figure 1:
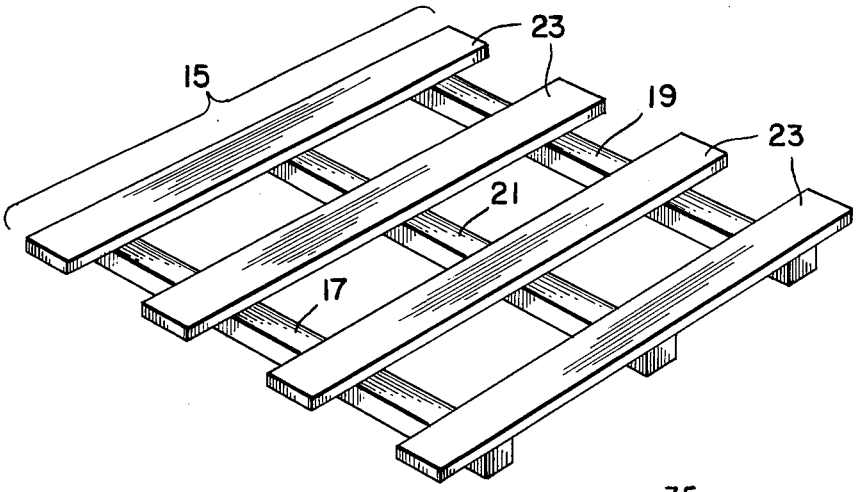
FIG. 1 is a perspective view of the expendable shipper skid according to the present invention.

Referring now to the drawings in detail, the separable pallet assembly 11 of the present invention comprises a heavy-duty permanent pallet 13 which is adapted to have mounted thereon an expendable, light-weight shipper skid 15 on which merchandise intended for shipment is loaded and is shipped together with such merchandise.

The expendable, light-weight, shipper skid 15, as shown in FIG. 1, is made of light-weight hardwood lumber, or if desired, suitable plastic or corrugated cardboard, and includes a pair of parallel end runners 17 and 19 and an intermediate or alignment runner 21 that is parallel to end runners 17 and 19. A plurality of parallel deckboards 23 are secured to the upper edge of runners 17, 19 and 21 and extend transversely with respect to said runners. End runners 17 and 19 are inset a distance, as shown in FIG. 1, from the associated ends of the deckboards 23.

Figure 2:
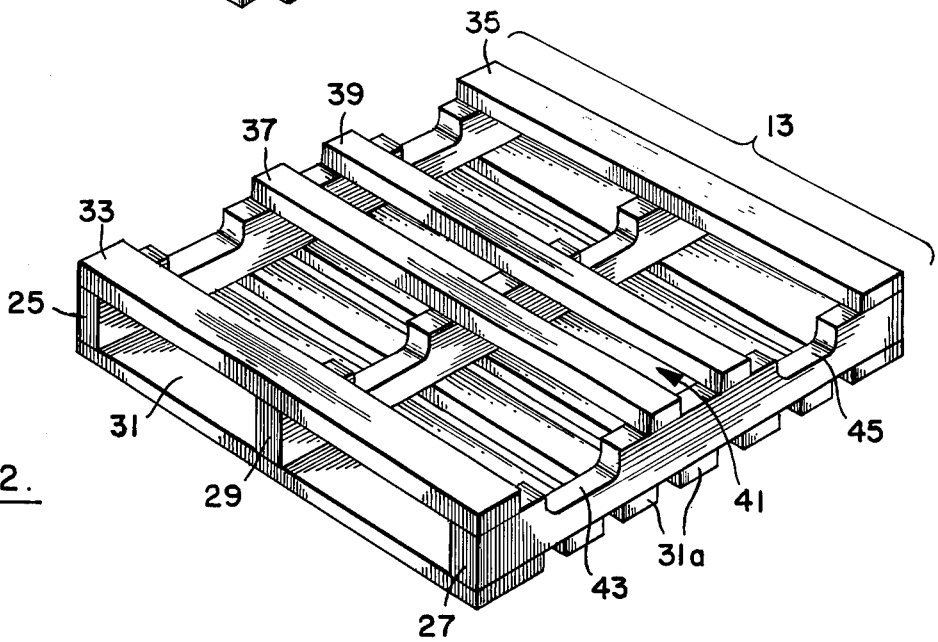
FIG. 2 is a perspective view of the heavy-duty permanent pallet.

The heavy-duty permanent pallet 13, as seen in FIG. 2, is made of solid hardwood, or if desired, suitable plastic having similar durable characteristics, so as to provide long lasting service. The permanent pallet includes a pair of parallel end runners 25 and 27 and an intermediate runner 29 which is parallel with end runners 25 and 27. Bottom boards 31 extend transversely of the runners 25, 27 and 29 and are secured to the bottom edge of runners 25, 27 and 29. Desirably the end boards 31 are wider than the intermediate boards 31*a*, as seen in FIG. 2.

The permanent pallet 13 is also provided with a top pair of parallel end boards 33 and 35 and a pair of intermediate or middle boards 37 and 39 that are parallel to said end boards 33 and 35. All of the top boards 33, 35 and 37, 39 extend transversely of runners 25, 27 and 29, and are secured to the upper edges of runners 25, 27 and 29.

Desirably, for added strength, the width of each of the end boards 33 and 35 is greater than that of the intermediate boards 37 and 39, as shown. The pair of intermediate boards 37 and 39 are closely spaced so as to form a groove 41 of width approximately the same or slightly greater than the width of intermediate runner 21 of shipper skid 15.

Figure 3:
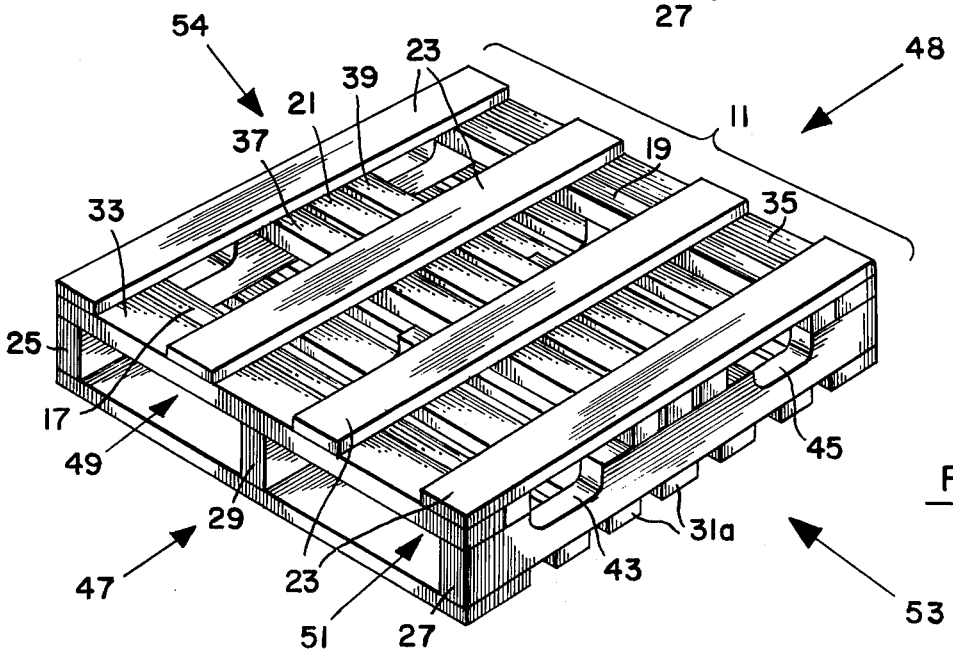
FIG. 3 is a perspective view of the pallet assembly according to the invention.

Referring to FIGS. 2 and 3, it is seen that the middle runner 21 of the shipper pallet 15 is adapted to fit in and be seated in groove 41. With runner 21 in the groove 41, runner 17 of the shipper skid 15 lies alongside the inside edge of end board 33 of the heavy-duty permanent pallet 13. Runner 19 of the shipper skid 15 then lies alongside the inside edge of end board 35 of permanent pallet 13.

As seen in FIGS. 2 and 3, two notches 43 and 45 are cut in each of the runners 25, 27 and 29 of the permanent pallet 13. These notches 43 and 45 admit the tines of a forklift to facilitate lifting the shipper pallet 15 and the load thereon from the bottom heavy-duty permanent pallet 13.

In operation in a manufacturing plant, warehouse or other storage area, the pallet assembly 11 is entered by forklift from end 47 of the assembly 11 or from the opposite end 48, with the forklift tines entering pallet grooves 49 and 51 formed between end runner 25 and intermediate runner 29, and between intermediate runner 29 and end runner 27.

For lifting the shipper 15 only and its load, the forklift tines enter the grooves 43 and 45 from the end 53, or the opposite end 54, of the assembly 11. Thus, instead of shipping the whole pallet assembly 11 and the load thereon, only the expendable shipper 15 and the load is shipped. The heavy-duty pallet 13 is retained for repetitive use.

It is noted that the permanent pallet 13 is available for use as a pallet in the plant or warehouse. For such use, the permanent pallet 13 is simply inverted so that the top boards 33, 35 and 37, 39 become the lower boards and engage the ground or floor or other surface supporting the pallet 13. The bottom boards 31 then become the load receiving deck.

Although inexpensive in construction, both in materials used and structural arrangement, the shipper 15 adequately serves the purpose of supporting a load for one-way shipment to a remote location, following which it may be discarded. Thus, instead of shipping and risking damage to or the non-return of the expensive, heavy-duty, high quality pallet, only a very inexpensive, one-way shipper skid is used. The expensive, heavy-duty, high quality pallet 13 is retained at the location of the manufacturer or warehouseman where damage or loss due to mishandling or for other reasons is minimized. Consequently, the life of the expensive permanent pallet is extended thereby contributing to a reduction in the expense of shipping.

I claim:

1. A pallet comprising deckboards with runners depending therefrom, positioning means on said pallet for positioning and locating an expendable skid on the pallet, said positioning means comprising a pair of deckboards spaced apart to form a position-location groove adapted to receive an alignment runner of said expendable skid, and an expendable skid placed on said pallet, said skid having a deckboard and runners depending therefrom, said skid runners including an alignment runner depending from the skid deckboard, said skid alignment runner being placed in said pallet position-location groove to properly position said skid on said pallet, whereby said groove confines the alignment runner on both sides from movement in either direction transverse to said groove.

2. A pallet comprising deckboards with runners depending therefrom, positioning means on said pallet for positioning and locating an expendable skid on the pallet, said positioning means comprising a pair of deckboards spaced apart to form a position-location groove adapted to receive an alignment runner of said expendable skid, and an expendable skid placed on said pallet, said skid having a deckboard and runners depending therefrom, said skid runners including an alignment runner depending from the skid deckboard, said skid alignment runner being placed in said pallet position-location groove to properly position said skid on said pallet, said skid runners also including a pair of end runners depending from the skid deckboard, said skid end runners being inset from the ends of the skid deckboard, said skid alignment runner resting on the pallet runners, each of said skid end runners lying alongside an inside edge of an associated pallet deckboard and resting on the pallet runners, and the skid deckboard resting on the pallet deckboards.

* * * * *